US007331818B2

(12) United States Patent
Wu et al.

(10) Patent No.: US 7,331,818 B2
(45) Date of Patent: Feb. 19, 2008

(54) CARD CONNECTOR ASSEMBLY WITH REINFORCING ELEMENTS

(75) Inventors: Tsu-Yang Wu, Tu-Cheng (TW); Yu-San Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 15 days.

(21) Appl. No.: 11/645,421

(22) Filed: Dec. 26, 2006

(65) Prior Publication Data

US 2007/0149006 A1 Jun. 28, 2007

(30) Foreign Application Priority Data

Dec. 26, 2005 (TW) ..... 94222619 U

(51) Int. Cl.
*H01R 13/73* (2006.01)

(52) U.S. Cl. ..... 439/573; 439/569

(58) Field of Classification Search ..... 439/569, 439/570, 566, 564, 567, 562, 563, 573
See application file for complete search history.

(56) References Cited

U.S. PATENT DOCUMENTS 5,230,633 A * 7/1993 Hisatomi et al. ..... 439/79
5,249,983 A * 10/1993 Hirai ..... 439/573
5,622,519 A * 4/1997 Bixler et al. ..... 439/570
6,007,352 A * 12/1999 Azuma et al. ..... 439/108
6,022,244 A * 2/2000 Chiu ..... 439/570
6,086,418 A * 7/2000 Chang ..... 439/573
6,382,984 B1 * 5/2002 Yu ..... 439/64
6,468,094 B2 * 10/2002 Kuo ..... 439/108
6,478,617 B2 * 11/2002 Fan ..... 439/570
6,623,298 B2 * 9/2003 Lin et al. ..... 439/570
6,733,335 B2 * 5/2004 Wu ..... 439/570
6,767,235 B2 * 7/2004 Wu ..... 439/328
6,935,895 B2 * 8/2005 Fan ..... 439/607
7,001,212 B1 * 2/2006 Juntwait ..... 439/566
7,074,079 B2 * 7/2006 Higuchi ..... 439/566
7,204,707 B2 * 4/2007 Kawase et al. ..... 439/247
2002/0039859 A1 * 4/2002 Fan ..... 439/570
2003/0119357 A1 * 6/2003 Lin et al. ..... 439/570
2004/0121632 A1 * 6/2004 Takata ..... 439/83
2004/0219830 A1 * 11/2004 Fan ..... 439/570
2005/0221667 A1 * 10/2005 Higuchi ..... 439/566
2005/0227534 A1 * 10/2005 Nakano ..... 439/566
2006/0009091 A1 * 1/2006 Sasaki et al. ..... 439/877
2006/0052006 A1 * 3/2006 Amano et al. ..... 439/638
2006/0189182 A1 * 8/2006 Higeta et al. ..... 439/79
2007/0020995 A1 * 1/2007 Hou ..... 439/569

* cited by examiner

*Primary Examiner*—Ross N. Gushi
(74) *Attorney, Agent, or Firm*—Wei Te Chung

(57) ABSTRACT

A card connector assembly (1) according to an embodiment includes an elongate insulative housing (10), a plurality of terminals (12), a pair of fastening members (14) and a pair of metal reinforcing elements (16). The plurality of terminals is held in the insulative housing with lower portions (123) for being soldered to a printed circuit board (2). The pair of fastening members is located around opposite ends of the insulative housing for fixing the insulative housing to the printed circuit board. The reinforcing element includes a first portion (162) for being attached to the insulative housing, and a second portion (164) adapted for being soldered to the printed circuit board at a mounting surface. The reinforcing elements are disposed adjacent the fastening members such that deformation caused by connecting the fastening members to the printed circuit board is prevented.

12 Claims, 6 Drawing Sheets

CARD CONNECTOR ASSEMBLY WITH REINFORCING ELEMENTS

BACKGROUND OF THE INVENTION

1. Field of the Invention

The present invention relates to the art of electrical connectors, and more particularly to a card connector assembly for electrical connections to memory devices in the form of cards, such as memory cards or hard disk drive (HDD) packages.

2. Description of the Related Art

Card connectors have been widely used in personal computers, lap-top computers, notebook type computers and the like. A conventional card connector 1' as shown in FIGS. 5 and 6, includes an insulative housing 10' of a generally elongate shape, and a row of terminals 12' assembled with the insulative housing 10'. The card connector 1' is fixed on a predetermined area of a printed circuit board 2' by soldering the row of terminals 12' to contact pads (not shown) of the printed circuit board 2'. In order to maintain the fixture of the card connector 1' to the printed circuit board 2', a pair of fasteners 14' is then applied and located around opposite ends of the insulative housing 10' for reliably fixing the card connector 1' to the printed circuit board 2'.

A problem with the card connector 1' is that there is deformation at a mounting surface 101' of the insulative housing 10'. This is so because force generated by the soldering connection of the terminals 12' to the printed circuit board 2' is not counterbalanced by force caused by fixing the fasteners 14'. This will directly result in electrical connection failure between the card connector 1' and the printed circuit board 2'.

SUMMARY OF THE INVENTION

A card connector assembly of an embodiment is provided for mechanical and electrical connection to a printed circuit board (PCB). The card connector assembly includes an elongate insulative housing, a plurality of terminals, a pair of fastening members and a pair of reinforcing elements. The insulative housing defines a mounting surface adapted for being mounted onto the PCB. The plurality of terminals is held in the insulative housing. The terminals have lower portions adapted for being solderably connected to the printed circuit board. The pair of fastening members is located around opposite ends of the insulative housing for fixably connecting the insulative housing to the printed circuit board. The pair of reinforcing elements is made of metal. Each reinforcing element includes a first portion attached to the insulative housing, and a second portion adapted for being soldered to the PCB at the mounting surface. The reinforcing elements are disposed inwardly of the respective fastening members so as to relieve force resulted from connecting the fastening members to the PCB.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
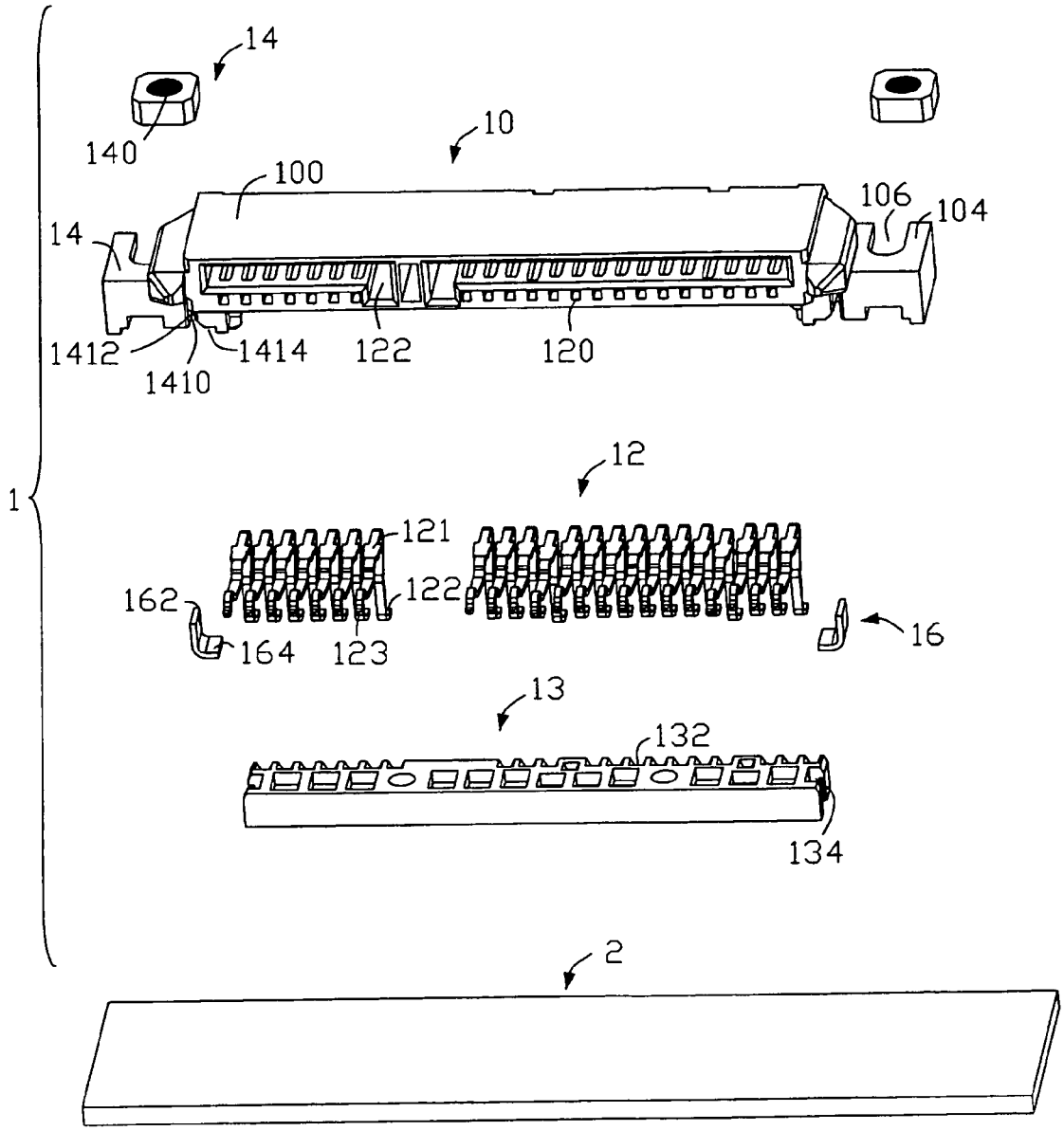
FIG. 1 is an exploded, perspective view of a card connector assembly according to a preferred embodiment of the present invention.
Figure 2:
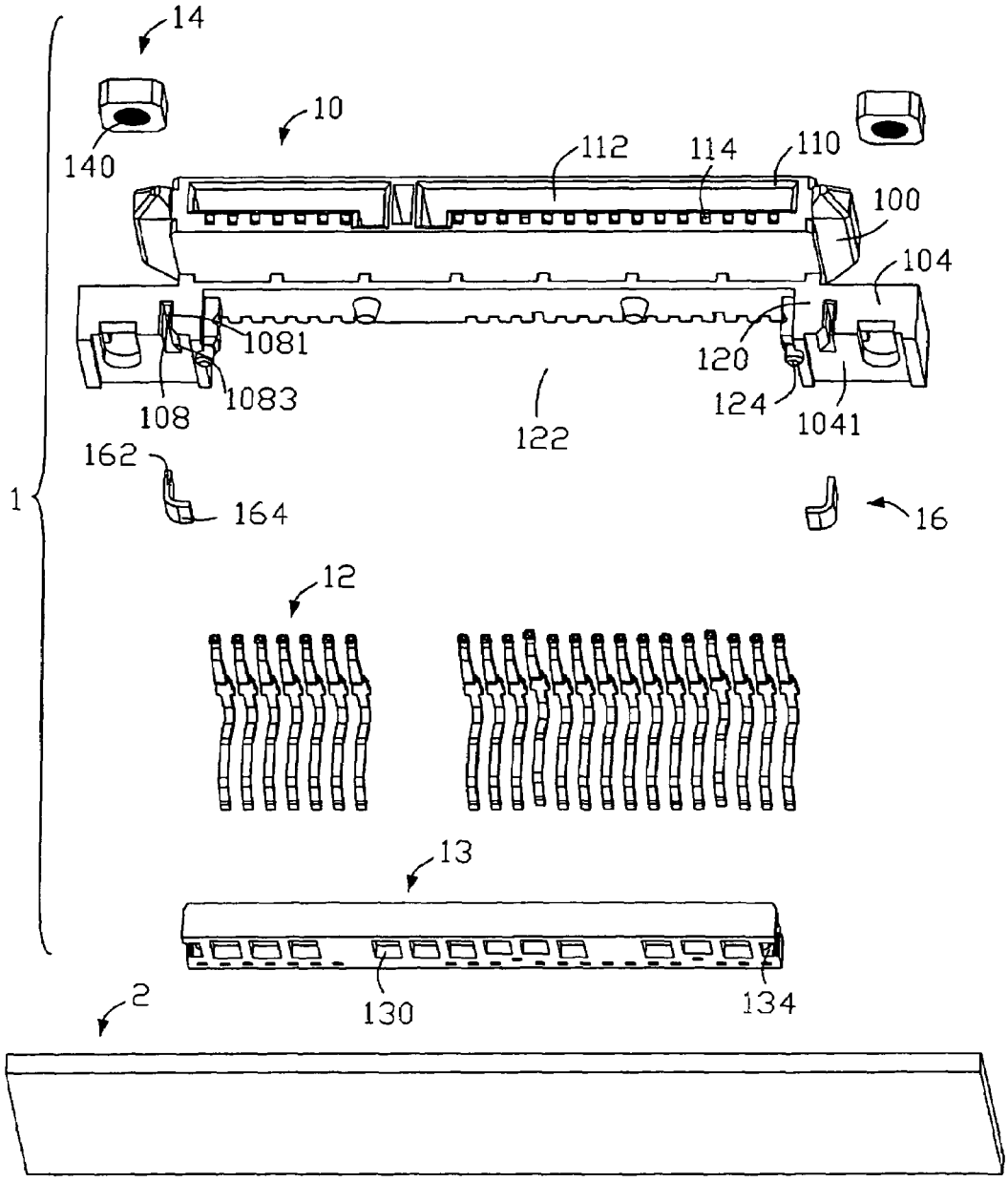
FIG. 2 is another perspective view of the card connector assembly of FIG. 1.
Figure 3:
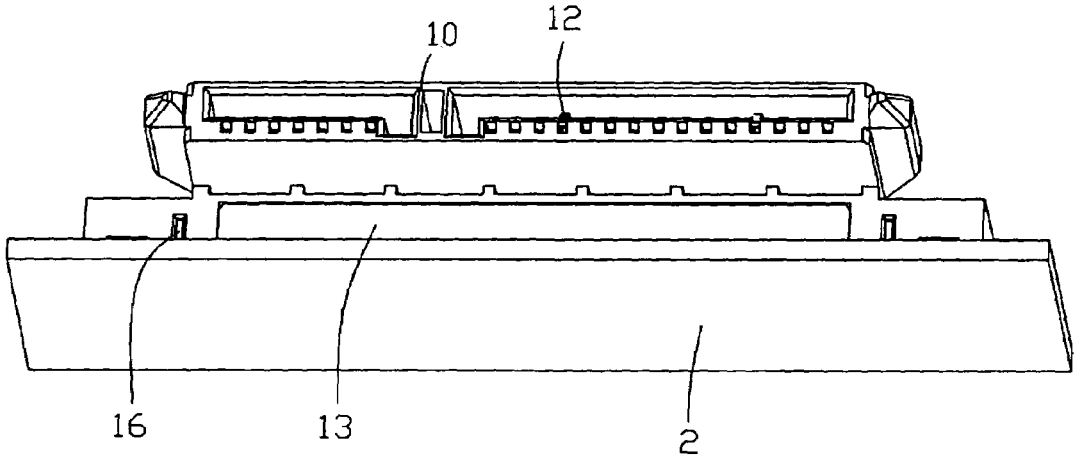
FIG. 3 is an assembled, perspective view of the card connector assembly of FIG. 1.
Figure 4:
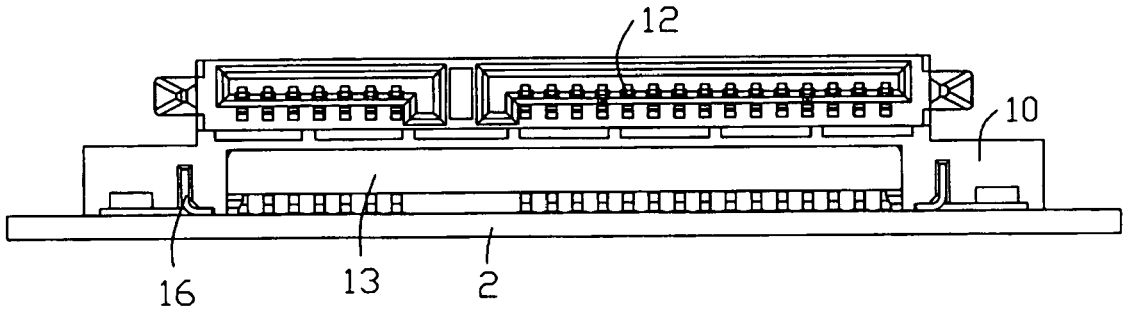
FIG. 4 is another perspective view of the card connector assembly of FIG. 1.
Figure 5:
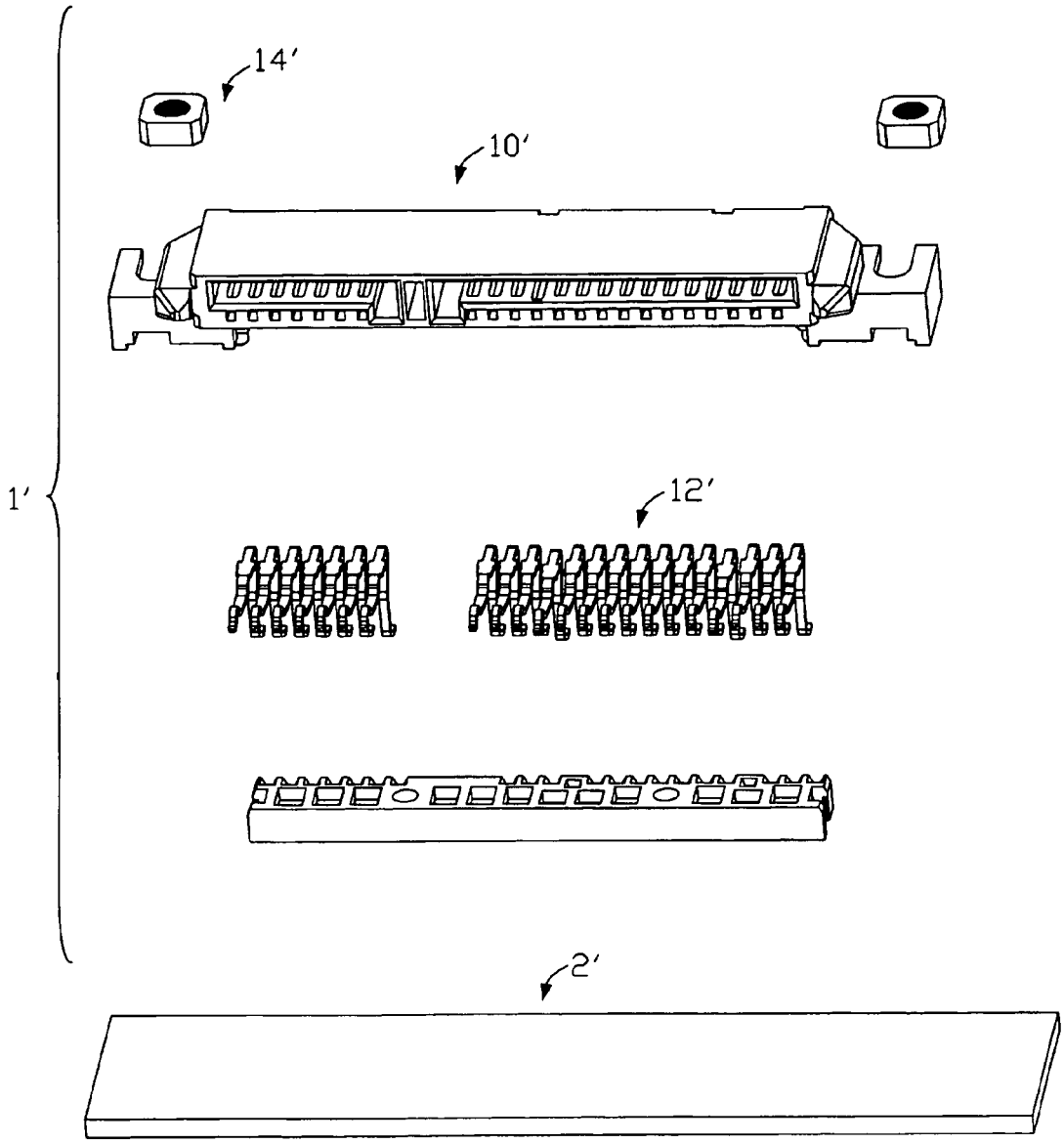
FIG. 5 (Prior Art)
FIG. 5 is an exploded, perspective view of a conventional card connector assembly.
Figure 6:
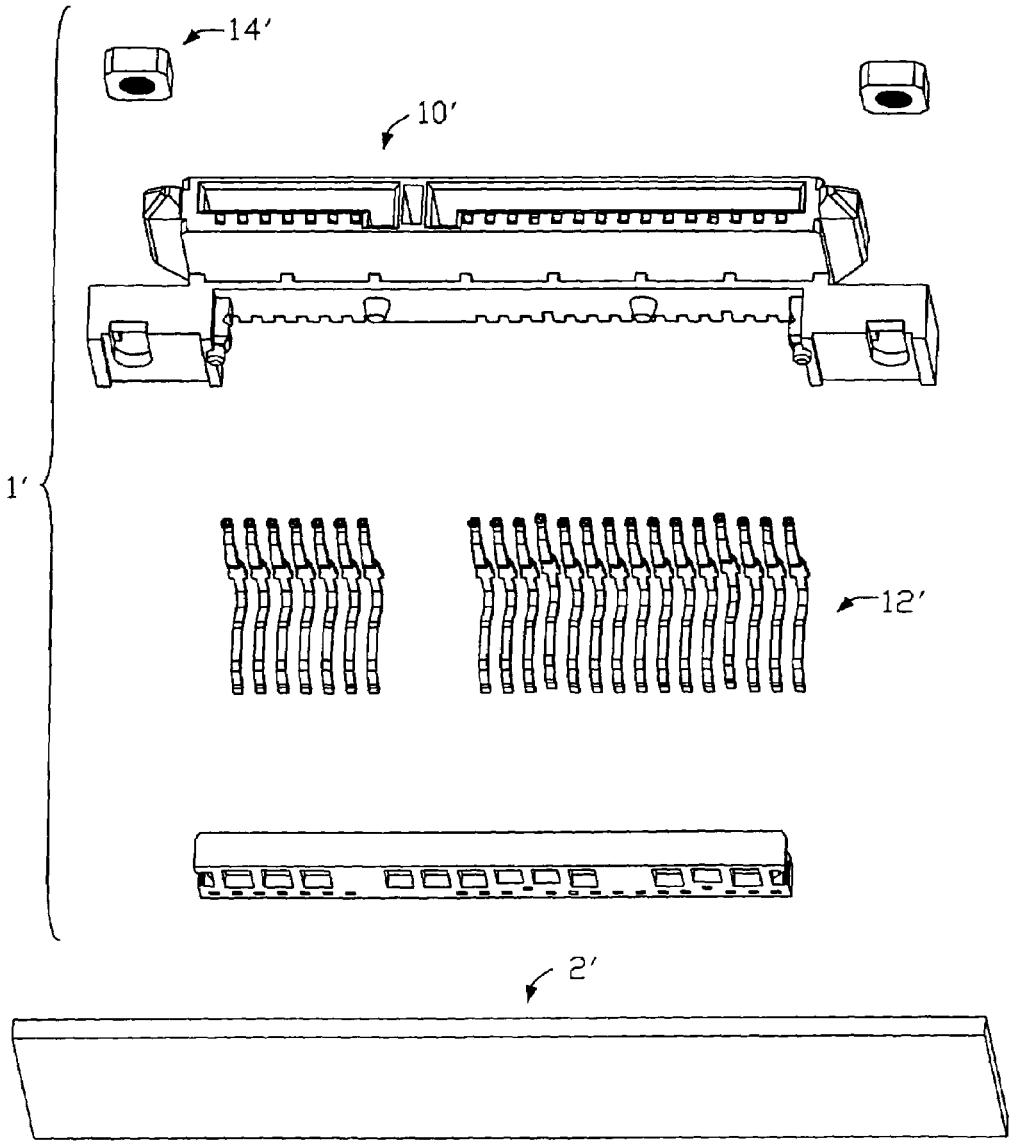
FIG. 6 (Prior Art)
FIG. 6 is another perspective view of the card connector assembly of FIG. 5.

Referring to FIGS. 1 to 4, a card connector assembly 1 according to the preferred embodiment is shown for electrical connections to a memory devices in the form of a card, such as a PC card or a hard disk drive (HDD) package (not shown), and a printed circuit board 2. The card connector assembly 1 includes an insulative housing 10, a plurality of terminals 12, a pair of fasteners 14, and a pair of reinforcing elements 16.

The insulative housing 10 is of an elongated shape, and includes a main body 100, a pair of extension sections 104 extending from opposite ends of the main body 100. The main body 100 includes an upper section 110 and a lower section 120. The upper section 110 defines an L-shaped upper compartment 112 for accommodating another circuit board (not shown) and a row of passageways 114 communicating with the upper compartment 112 for receiving the respective terminals 12. The lower section 120 defines a lower compartment 122 adapted for receiving an elongated retention piece 13 (to be later described) therein. The extension sections 104 define a mounting surface 1041 where the insulative housing 10 of the card connector assembly 1 is soldered to the printed circuit board 2. Each of the extension sections 104 includes a longitudinal U-shaped groove 106 extending therethrough and an L-shaped slot 108 adjacent the U-shaped groove 106 and extending from the mounting surface 1041. The U-shaped groove 106 is adapted for accommodating the fastener 14, by which the insulative housing 10 of the card connector assembly 1 is fixed to the printed circuit board 2. The L-shaped slot 108 is adapted for holding the reinforcing element 16 in position. Each L-shaped slot 108 is further composed of a first vertical section 1081 and a second horizontal section 1083. The first vertical section 1081 is configured to hold a first vertical feet 162 of the reinforcing element 16 in position, while the second horizontal section 1083 is adapted for partly receiving a horizontal feet 164 of the reinforcing element 16 with a bottom surface of the horizontal section 164 exposed to be soldered to the printed circuit board 2. Further, a pair of positioning pins 124 is located adjacent opposite sides of the lower compartment 122 for being inserted into a pair of positioning holes 134 of the retention piece 13.

The retention piece 13 also forms a plurality of second passageways 130 corresponding to the first passageways 114 so as to cooperate with the first passageways 114 to hold the respective terminals 12 in position, when the terminals 12 are received in the insulative housing 10. Further, the retention piece 13 is formed with the pair of positioning holes 134 at opposite ends thereof for receiving the positioning pins 124 so as to fix the retention piece 13 to the insulative housing 10.

Each of the terminals 12 includes a retention part 121, an upper part and a lower part extending upwardly and downwardly from the retention part 121 to form a first contact end 122 and an opposite second contact end 123. The second contact end 122 is adapted to engage the printed circuit board 2, while the second contact end 123 is adapted for mating with the circuit board. The terminals 12 are held in the insulative housing 10 by means of combination of the second passageways 130 of the retention piece 13 and the first passageways 114 formed on the upper section 110.

In this embodiment, each of the fasteners 14 includes a pair of mating machine components including nut 140 and bolt (not shown). The machine nut 140 and bolt are threaded to engage with each other so as to fix the insulative housing 10 to the printed circuit board 2 by the fastener 14. It should be noted that the fastener 14 could have other suitable configuration, such as including nails, rivets or non-threaded nut, etc. .

The reinforcing element 16 is generally of an L-shaped configuration. The reinforcing element 16 includes a first vertical foot 162 and a second horizontal foot 164 bent at a right angle from the vertical foot 162. The first vertical foot 162 is preferably interferingly inserted into the vertical section 1081 of the L-shaped slot 108. The horizontal foot 164 is partly received within the horizontal section 1083 of the L-shaped slot 108, with a bottom surface of the horizontal foot 164 exposed out of the mounting surface 1041 of the insulative housing 10. The horizontal foot 164 has the bottom surface adapted for being soldered to the printed circuit board 2. The horizontal feet 164 of the reinforcing element 16 are coplanar with respect to the mounting surface 1041 of the insulative housing 10, thereby permitting the simultaneous soldering of the terminals 12 and the horizontal feet 164 of the reinforcing elements 16 to the printed circuit board 2.

Referring still to FIGS. 1 to 4, in assembly, the terminals 12 are pre-assembled into the first passageways 114 of the insulative housing 10. The retention piece 13 is assembled into the lower compartment 122 by engagement of the positioning pins 124 and the positioning holes 134 to permit the terminals 12 continuously extending into the second passageways 130 of the retention piece 13 so as to hold the terminals 12 in position. The metal reinforcing elements 16 are assembled onto adjacent the opposite ends of the lower compartment 122 by its vertical foot 162 interferingly inserted into the vertical section 1081 of the L-shaped slot 108, and its horizontal foot 164 partly received in the horizontal section 1083 of the slot 108 with the bottom surface of the horizontal foot 164 exposed. Then, the card connector assembly 1 is soldered onto a predetermined area of the printed circuit board 2 by simultaneously reflow-soldering the second contact ends 123 of the terminals 12 and the horizontal feet 164 of the metal reinforcing elements 16. After the soldering process, the pair of fasteners 14 is applied to the insulative housing 10 by guidably inserting the nuts 140 into the U-shaped grooves 106, and the pins threaded into the nuts 140 to maintain the position of the card connector assembly 1 and the printed circuit board 2. With such metal reinforcing elements 16 serving as strain relief, deformation caused by mounting the fastener 14, which otherwise would affect the terminals 12, is prevented.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A card connector assembly for mechanical and electrical connection to a printed circuit board (PCB), the card connector assembly comprising:

an elongate insulative housing defining a mounting surface adapted to be mounted onto the printed circuit board;

a plurality of terminals held in the insulative housing, the terminals having lower portions adapted to be solderably connected to the PCB;

a pair of fastening members located around opposite ends of the insulative housing for fixably connecting the insulative housing to the printed circuit board; and a pair of reinforcing elements made of metal, each reinforcing element including a first portion attached to the insulative housing, and a second portion adapted for being soldered to the printed circuit board at the mounting surface, the reinforcing elements disposed inwardly of the respective fastening members to relieve force resulting from connecting the fastening members to the PCB.

2. The card connector assembly as recited in claim 1, wherein the first portion is configured to be at a right angle with the second portion.

3. The card connector assembly as recited in claim 1, wherein the insulative housing includes a slot extending from the mounting surface, and the slot has a first part configured for interferingly receiving the first portion of the reinforcing element.

4. The card connector assembly as recited in claim 3, wherein the second portion has a bottom surface exposed out of the mounting surface for being soldered onto the printed circuit board.

5. An electrical connector assembly comprising:

a printed circuit board defining at least one fastening through hole;

an electrical connector mounted upon the printed circuit board an including:

an elongated insulative housing defining at least one mating port in a front face and at least one fastening region at one end;

a plurality of terminals disposed in the housing with contacting portions extending into the mating port and mounting legs soldered on the printed circuit board, respectively;

a screw nut located on said end so as to allow a screw to extend therethrough and further into the fastening through hole to fasten the connector to the printed circuit board; wherein a metallic reinforcement device is located between the fastening region and the mating port, and includes at least a soldering plate fastened to the printed circuit board so as to share forces transferred from the fastening region, with the mounting legs.

6. The electrical connector assembly as claimed in claim 5, wherein said reinforcement device includes a retention plate retainably inserted into the housing.

7. The electrical connector assembly as claimed in claim 5, wherein said reinforcement is located below a mating post, which is located at one end of the mating port.

8. The electrical connector assembly as claimed in claim 7, wherein said reinforcement device is located beside a positioning pin which is couple to a retention piece which cooperates with the housing to hold the mounting legs in position.

9. An electrical connector assembly comprising:

a printed circuit board defining at least one fastening through hole;

an electrical connector mounted upon the printed circuit board an including:

an elongated insulative housing defining at least one mating port in a front face and at least one fastening region at one end;

a plurality of terminals disposed in the housing with contacting portions extending into the mating port and mounting legs soldered on the printed circuit board, respectively;

a screw nut located on said end so as to allow a screw to extend therethrough and further into the fastening through hole to fasten the connector to the printed circuit board; wherein a metallic reinforcement device is located between the fastening region and the mating port, and includes at least a horizontal plate directly seated upon the printed circuit board so as to resist downward forces transferred from the fastening region, for the mounting legs.

10. The electrical connector assembly as claimed in claim 9, wherein said reinforcement device includes a retention plate retainably inserted into the housing.

11. The electrical connector assembly as claimed in claim 9, wherein said reinforcement is located below a mating post, which is located at one end of the mating port.

12. The electrical connector assembly as claimed in claim 11, wherein said reinforcement device is located beside a positioning pin which is couple to a retention piece which cooperates with the housing to hold the mounting legs in position.

* * * * *